US009334451B2

(12) United States Patent
Koseoglu et al.

(10) Patent No.: US 9,334,451 B2
(45) Date of Patent: May 10, 2016

(54) HIGH QUALITY MIDDLE DISTILLATE PRODUCTION PROCESS

(75) Inventors: Omer Refa Koseoglu, Dhahran (SA); Adnan Al-Hajji, Dammam (SA); Ali Mahmood Al-Somali, Dhahran (SA); Hendrik Muller, Dhahran (SA); Mohammed Abdullah Al-Ghamdi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 375 days.

(21) Appl. No.: 12/724,331

(22) Filed: Mar. 15, 2010

(65) Prior Publication Data

US 2011/0220546 A1 Sep. 15, 2011

(51) Int. Cl.

| | |
|---|---|
| ***C10G 67/04*** | (2006.01) |
| ***C10G 47/00*** | (2006.01) |
| ***C10G 67/06*** | (2006.01) |
| ***C10G 67/14*** | (2006.01) |

(52) U.S. Cl.

CPC ..... *C10G 47/00* (2013.01); *C10G 67/04* (2013.01); *C10G 67/0409* (2013.01); *C10G 67/06* (2013.01); *C10G 67/14* (2013.01); *C10G 2300/1096* (2013.01)

(58) Field of Classification Search

CPC ..... C10G 2300/1096; C10G 2300/1051; C10G 2300/1055; C10G 2300/1059; C10G 2300/30; C10G 2400/08

USPC ..... 208/58

See application file for complete search history.

(56) References Cited

U.S. PATENT DOCUMENTS

| | | | | |
|---|---|---|---|---|
| 3,174,925 | A | | 3/1965 | Claussen et al. |
| 3,180,817 | A | | 4/1965 | Claussen et al. |
| 3,180,818 | A | | 4/1965 | Claussen |
| 3,240,694 | A | | 3/1966 | Mason et al. |
| 3,389,075 | A | * | 6/1968 | Addison ..... 208/66 |
| 3,420,768 | A | | 1/1969 | Bray, at al. |
| 3,507,777 | A | | 4/1970 | Hemminger |
| 3,533,938 | A | | 10/1970 | Leas |

(Continued)

FOREIGN PATENT DOCUMENTS

| | | |
|---|---|---|
| EP | 0280476 | 8/1988 |
| GB | 1056449 | 1/1967 |
| WO | WO0027950 | 5/2000 |

OTHER PUBLICATIONS

Hunt, Relation of Smoke Point to Molecular Structure, vol. 5m, No. 3.*

(Continued)

*Primary Examiner* — Randy Boyer
*Assistant Examiner* — Juan Valencia
(74) *Attorney, Agent, or Firm* — Abelman, Frayne & Schwab

(57) ABSTRACT

A hydrocarbon feedstock is hydrocracked in a hydrocracking zone and the effluent is fractioned to recover a light fraction, a middle fraction containing aromatic compounds and a heavy fraction. The heavy fraction is recycled to the hydrocracking zone for further hydrocracking. The middle fraction is introduced to an aromatic separation zone. A product stream is recovered from the aromatic separation zone comprising a middle fraction having a reduced content of aromatic compounds as compared to the middle fraction recovered from the fractionator. Aromatics from the aromatic separation zone are recycled to the hydrocracking zone for further hydrogenation and cracking.

11 Claims, 6 Drawing Sheets

(56) References Cited

U.S. PATENT DOCUMENTS

| | | | | | |
|---|---|---|---|---|---|
| 3,592,757 | A | * | 7/1971 | Baral | 208/58 |
| 3,617,486 | A | | 11/1971 | Lewis et al. | |
| 3,655,551 | A | | 4/1972 | Hass et al. | |
| 3,767,562 | A | * | 10/1973 | Sze et al. | 208/57 |
| 3,787,314 | A | | 1/1974 | Donaldson et al. | |
| 3,788,975 | A | | 1/1974 | Donaldson | |
| 3,929,617 | A | * | 12/1975 | Henry et al. | 208/96 |
| 3,954,600 | A | | 5/1976 | Gladrow et al. | |
| 4,178,228 | A | | 12/1979 | Chang | |
| 4,354,922 | A | | 10/1982 | Derbyshire et al. | |
| 4,359,596 | A | | 11/1982 | Howard et al. | |
| 4,447,315 | A | * | 5/1984 | Lamb et al. | 208/99 |
| 4,592,832 | A | | 6/1986 | Bristow et al. | |
| 4,713,167 | A | | 12/1987 | Reno et al. | |
| 4,764,266 | A | | 8/1988 | Chen et al. | |
| 4,851,109 | A | * | 7/1989 | Chen et al. | 208/58 |
| 4,909,927 | A | | 3/1990 | Bell | |
| 4,950,384 | A | | 8/1990 | Groeneveld et al. | |
| 4,985,134 | A | | 1/1991 | Derr et al. | |
| 5,021,143 | A | | 6/1991 | Franckowiak et al. | |
| 5,026,472 | A | | 6/1991 | Hoehn et al. | |
| 5,059,303 | A | | 10/1991 | Taylor et al. | |
| 5,110,445 | A | | 5/1992 | Chen et al. | |
| 5,880,325 | A | | 3/1999 | Alward et al. | |
| 5,885,440 | A | | 3/1999 | Hoehn et al. | |
| 5,904,835 | A | | 5/1999 | Thakkar | |
| 6,113,775 | A | | 9/2000 | Christolini et al. | |
| 6,217,746 | B1 | | 4/2001 | Thakkar et al. | |
| 6,312,586 | B1 | | 11/2001 | Kalnes et al. | |
| 6,702,935 | B2 | | 3/2004 | Cash et al. | |
| 6,866,772 | B2 | | 3/2005 | Selai et al. | |
| 2003/0236176 | A1 | * | 12/2003 | Holst-Grubbe et al. | 508/167 |
| 2006/0260981 | A1 | | 11/2006 | Gosling et al. | |
| 2008/0105595 | A1 | | 5/2008 | Koseoglu | |

OTHER PUBLICATIONS

Hunt, R.A. "Relation of Smoke Point to Molecular Structure" Ind. Eng. Chem., vol. 45, No. 3, (1953); 602-606.

International Search Report mailed on Apr. 25, 2011 by the ISA/US in application No. PCT/US11/24862, pp. 1-6.

* cited by examiner

HIGH QUALITY MIDDLE DISTILLATE PRODUCTION PROCESS

RELATED APPLICATIONS

[Not applicable]

BACKGROUND OF THE INVENTION

1. Field of the Invention

This invention relates to improvements in production processes for hydrocarbon middle distillates, and in particular to an integrated hydrocracking and aromatic removal process for heavy hydrocarbons to produce middle distillates useful as cleaner burning transportation fuels having reduced pollutants.

2. Description of Related Art

Hydrocracking processes are used commercially in a large number of petroleum refineries. One typical application of hydrocracking is to process a variety of feeds boiling in the range of 370° C. to 520° C. in conventional units and feeds boiling at 520° C. and above in residue units. In general, hydrocracking processes break the carbon-carbon bonds in feed molecules into simpler molecules (e.g., light hydrocarbons) having higher average volatility and economic value. Additionally, hydrocracking processes typically improve the quality of the hydrocarbon feedstock by increasing the hydrogen-to-carbon ratio and by removing organosulfur and organonitrogen compounds. The significant economic benefit derived from hydrocracking processes has resulted in substantial development of process improvements and more active catalysts.

Hydrocracking units generally include two principal zones, a reaction zone and a separation zone. In addition, there are three commonly used process configurations, including single stage, series-flow (also called once-through) with and without recycle, and two stage with recycle. Key parameters such as feedstock quality, product specification/processing objectives and catalyst selection typically determine the reaction zone configuration.

Mild or single stage once-through hydrocracking occurs at operating conditions that are more severe than typical hydrotreating processes, and less severe than conventional full pressure hydrocracking processes. Mild hydrocracking is more cost effective, but typically results in production of less middle distillate products of a relatively lower quality as compared to conventional hydrocracking. Single or multiple catalyst systems can be used depending upon the feedstock processed and product specifications. Single stage hydrocracking units are generally the simplest configuration, designed to maximize middle distillate yield over a single or dual catalyst systems. Dual catalyst systems are used in a stacked-bed configuration or in two different reactors.

Feedstock is typically refined over one or more amorphous-based hydrotreating catalysts, either in the first catalyst zone in a single reactor, or in the first reactor of a two-reactor system. The effluents of the first stage are then passed to the second catalyst system consisting of an amorphous-based catalyst or zeolite catalyst having hydrogenation and/or hydrocracking functions, either in the bottom of a single reactor or the second reactor of two-reactor system.

In two-stage configurations, which can also be operated in a "recycle-to-extinction" mode of operation, the feedstock is refined by passing it over a hydrotreating catalyst bed in the first reactor. The effluents together with the second stage effluents are passed to a fractionator column to separate the $H_2S$, $NH_3$, light gases ($C_1$-$C_4$), naphtha and diesel products boiling in the temperature range of 36-370° C. The unconverted bottoms, free of $H_2S$, $NH_3$, are sent to the second stage for complete conversion. The hydrocarbons boiling above 370° C. are then recycled to the first stage reactor or the second stage reactor.

In both configurations, hydrocracking unit effluents are sent to a distillation column to fractionate the naphtha, jet fuel/kerosene, diesel and unconverted products boiling in the nominal ranges of 36-180° C., 180-240° C., 240-370° C. and above 370° C., respectively. The hydrocracked jet fuel/kerosene products (i.e., smoke point >25 mm) and diesel products (i.e., cetane number >52) are of high quality and well above the worldwide transportation fuel specifications. While hydrocracking unit effluents generally have low aromaticity, any aromatics that remain will lower the key indicative properties of smoke point and cetane numbers for these products.

Jet fuel quality is measured by national and international specifications which are used by end-users and producers to identify and control the properties necessary for satisfactory and reliable performance. The specifications of four types of aviation fuels, defined by the International Air Transport Association (LATA), are "Jet A," "Jet A-1," "TS-1" and "Jet B." Jet B is a wide-cut fuel, while Jet A, Jet A-1 and TS-1 are kerosene-type fuels. For example, Jet A is used in the United States, while most other nations use Jet A-1. TS-1 meets the Russian GOST (Gosudarstvennyy Standart) requirements, and Jet B meets the CGSB (Canadian General Standards Board) requirements. The important difference between the fuels is that Jet A-1 has a lower maximum freezing point than Jet A. Jet A has a freezing point of −40° C., while Jet A-1 has a has a freezing point of −47° C. The lower freezing point makes Jet A-1 more suitable for long international flights, especially on polar routes during the winter seasons. Jet A is suitable for use in the United States for domestic flights.

Hydrocarbon compounds in jet fuel include paraffins (including n-paraffins and isoparaffins), naphthenes (i.e., cycloparaffins), aromatics and to a limited extent olefins. When jet fuels of the same specification differ in constitution, it is mainly due to the fact that they contain different proportions of compounds from these classes. The boiling point increases with increasing carbon numbers for compounds in the same class. For compounds of the same carbon number, the order of increasing boiling point by class is isoparaffin, n-paraffin, naphthene, and aromatic. The boiling point differential between isoparaffin and aromatic hydrocarbons of the same carbon number is often the same as or greater than the boiling point differential between compounds of the same class that differ by one carbon number (greater than 20° C.). For $C_{10}$ hydrocarbons, the difference in boiling points between its aromatic class (naphthalene, BP 218° C.) and its paraffin class (n-decane, BP 174.2° C.) is over 43° C. Compounds that boil near 225° C., which is average for kerosene-type jet fuel, can be $C_{10}$ aromatics, $C_{11}$ naphthenes, and $C_{12}$ paraffins. For example, boiling points of naphthalene, n-hexyl cyclohexane and n-dodecane are 218° C., 225° C. and 216° C., respectively.

Smoke point is an important measure of the quality of jet fuel/kerosene. The hydrocarbon constitution of kerosene is often dependent on the source of the crude oil, and/or the nature of the intermediate refinery processes and conditions. The range of the molecular weights, or carbon numbers, of hydrocarbons for a given product is determined by the distillation, freezing point and, in certain instances, the naphthalene content and smoke point product requirements. For example, kerosene-type jet fuel boils in the range of 165-265° C. and contains between 8 and 16 carbon atoms, whereas wide-cut jet fuel boils in the range of 36-240° C. and contains between 5 and 15 carbon atoms.

Since the primary function of jet fuel is to power an aircraft, energy content and combustion quality are key fuel performance properties. Smoke point is one of the indicator tests to determine the combustion quality of jet fuels. ASTM D1322 is a common method used to determine the smoke point.

Smoke points of pure hydrocarbons, shown in FIG. 1, vary widely and are reported (Hunt R. A., Ind. Eng Chem., 45(3), 1953, pg. 602-606) to decrease as shown in the following table:

TABLE 1

| n-Paraffins > | Iso-Paraffins >> | Naphthenes >>> | Aromatics |
|---|---|---|---|
| 133-149 | 86-137 | 38-117 | 4-8 |

Straight chain paraffins have the highest smoke points and branching decreases the smoke point markedly, but the position of the branches on the molecule makes little difference. Naphthenes have about the same smoke point as highly branched paraffins and apparently the number of carbon atoms in the cyclo-alkane ring has little effect on the smoke point. Aromatics have low smoke points irrespective of the configuration of aliphatic side chains. For example, benzene and naphthalene have a smoke point of 8 mm and 4 mm, respectively.

Data obtained from pure compounds reported (Hunt R. A) that the compactness of the hydrocarbon molecule is responsible for its smoke point. In addition, the smoke point of paraffinic molecules decreases with increasing boiling point or carbon number. However, the smoke point of olefinic compounds generally remains constant with increasing carbon numbers.

The contribution of various types of hydrocarbons to the smoke point of a fuel mixture is not a linear relationship. Aromatics are the key hydrocarbon compounds that impact the smoke point of kerosene or jet fuel. FIG. 2 plots the carbon number against the smoke point of hydrocarbon mixture (1-methyl naphthalene and undodecane). As shown in FIG. 2, the smoke point declines exponentially with increasing aromatic carbon content of the fuel mixture. Therefore, removing aromatics will increase the smoke point, and hence enhance the combustion characteristics of a jet fuel.

Conventionally, most processes that produce middle distillates in the product stream retain aromatics boiling in the range of about 180-370° C. Aromatics boiling higher than the middle distillate range are also included with the heavier fractions. Therefore, attempts have been made to remove aromatics from hydrocarbon mixtures. However, common problems with existing proposed methods to reduce aromatics include a substantial reduction in the yield and increased process complexity.

Hemminger U.S. Pat. No. 3,507,777 discloses a cracking process using supercritical separation to isolate an oil phase and remove asphalt. The oil phase is directed to a cracking unit, followed by distillation producing a middle distillate fraction. The heaviest fraction of the distillation is recycled back to a cascade of supercritical separation units. Refractory aromatics included in the heaviest fraction are rejected along with tars and catalyst fines. In the process of Hemminger, aromatics not hydrogenated after a single pass through the cracking unit are included as bottoms that are rejected, thus lowering the product yield. Further, aromatics boiling in the middle distillate range remain in the product streams, therefore producing at best, a fuel product having typical amounts of aromatics, i.e., up to about 30% by volume, therefore lowering the smoke point and cetane number as discussed above.

Leas U.S. Pat. No. 3,533,938 discloses a process for preparing jet fuel blends primarily directed to conversion of coal liquids. Various feedstocks are charged into a hydrocracking unit, including coal liquids previously subjected to hydrotreating, distillate fuel oils derived from petroleum and heavier fractions previously subjected to destructive distillation. A light fraction from the hydrocracking unit is subject to a reformer stage, resulting in an increased aromatic content. The heavy fraction from the hydrocracking unit is subject to catalytic cracking followed by thermal cracking of the heavy catalytic cracked fraction. The light catalytic cracked fraction, the thermal cracking effluent and the reformer stage effluent all contain substantial volumes of aromatics, which are removed in an aromatic extraction stage. The light and heavy fractions are recycled to the thermal cracking unit and the catalytic cracking unit, respectively, and the aromatics are passed to an alkylation unit. Alkyl aromatics are saturated in a hydrogenation unit, and the products, alkyl and isoalkyl substituted napthenes, are discharged to the jet fuel blend. Leas discloses a complex process to produce and/or upgrade jet fuels. The amount of aromatics is increased at the reformer stage, further necessitating the separate alkylation and hydrogenation steps to convert extracted aromatics. In addition, the aromatic extraction unit is charged with a wide range of distillate feeds.

Derbyshire, et al. U.S. Pat. No. 4,354,922 discloses a process for upgrading a combination of crude petroleum residua, refractory bottoms from catalytic cracking operations, and coal to gasoline and middle distillate products. The process involves a dense-gas solvent extraction stage under supercritical conditions, in addition to cracking and hydroconversion stages. Middle distillate fractions are recovered in a distillation step downstream of thermal or catalytic cracking, and are not subjected to aromatic extraction or hydrocracking.

Hoehn, et al. U.S. Pat. No. 5,026,472 discloses a process in which high boiling point hydrocarbons are upgraded to products including low aromatic content kerosene or jet fuel in a dual reaction zone. Gas oil is fed to a hydrocracking reactor, and the effluent separated into a vapor fraction and a liquid fraction. The vapor fraction is partially condensed to yield a liquid having kerosene/diesel boiling range hydrocarbons, which is charged to a hydrogenation reactor. Liquid recovered from both reactors is charged to a common fractionator. The vapor fraction from the initial separation is hydrogenated to convert some of the aromatic compounds to hydrocarbons having higher hydrogen content. The hydrogenation effluent is admixed with the liquid fraction containing aromatics from the initial separator. The combined stream is then subject to distillation into $C_3$-$C_4$ hydrocarbons, gasoline, kerosene/diesel and heavy bottoms. Thus, aromatics are only removed from a portion of the vapor fraction of the initial separation.

Franckowiak, et al. U.S. Pat. No. 5,021,143 discloses a process of fractionation and extraction of hydrocarbons to increase the octane index and improve smoke point. According to the disclosure a charge with a final boiling point of at least 220° C. is fractionated into three fractions: light naphtha containing less than 10% aromatics and boiling in the range of 25-80° C.; medium naphtha boiling in the range of 80-150° C.; and heavy naphtha boiling in the range of 150-220° C. Aromatics are extracted from the heavy naphtha by a selective liquid solvent. The solvent is regenerated by re-extraction using light petrol so as to produce an aromatics-enriched petrol fraction with an improved octane number. Franckowiak, et al. is not concerned with optimizing the yield of low-aromatic or aromatic-free jet fuel/kerosene products.

Importantly, none of the above-described references include an integrated hydrocracking process in which aromatics boiling in the middle distillate range are removed to provide high quality jet fuel/kerosene products and diesel products.

It is therefore an object of this invention to provide an integrated hydrocracking process in which aromatics boiling in the middle distillate range are reduced or removed, while also optimizing product yield.

It is another object of the invention to provide such an integrated process in which modifications to existing facilities and equipment for hydrocracking are minimized.

BRIEF SUMMARY OF THE INVENTION

The above objects and further advantages are provided by the system and process for producing reduced aromatic hydrocarbon products. A hydrocarbon feedstock is hydrocracked in a hydrocracking zone and the effluent is fractioned to recover a light fraction, a middle fraction containing aromatic compounds and a heavy fraction. The heavy fraction is recycled to the hydrocracking zone for further hydrocracking. The middle fraction is introduced to an aromatic separation zone. A product stream is recovered from the aromatic separation zone comprising a middle fraction having a reduced content of aromatic compounds as compared to the middle fraction recovered from the fractionator. Aromatics from the aromatic separation zone are recycled to the hydrocracking zone for further hydrogenation and cracking (hydrocracking).

Accordingly, by the process of the present invention, high quality transportation fuels are obtained by removing, or reducing the content of, aromatic compounds from the hydrocracked and/or middle distillate streams from elsewhere in the same refinery complex or from another source.

Unlike the Leas process discussed above, in which separate alkylation and hydrogenation steps are required to convert extracted aromatics, the process and apparatus of the present invention recycles extracted aromatics to the hydrocracking zone for hydrogenation and, ultimately, for conversion to reduce the total aromatic volume, and in certain embodiments to produce an aromatic-free middle distillate fraction product.

Furthermore, whereas the Leas process requires a thermal cracking unit and a catalytic cracking unit downstream of the hydrocracking unit, the process and apparatus of the present invention can operate without these units. Thermal and catalytic cracking units are not required in the system and method of the present invention because the hydrocracking unit has the operating severity and flexibility to hydrogenate and crack the aromatic residue in the mid-distillate stream. The Leas patent describes a complex process stream with units not required by the system and method of the present invention.

Still further, the aromatic extraction unit in Leas process is charged with a wide range of fractions, which are separately recycled into different portions of the process. In contrast, in the process and system of the present invention, a fractionator is situated upstream of the aromatic separation zone. Therefore, the aromatic separation zone effluent is a product stream of reduced aromatic content or a substantially aromatic-free middle distillate hydrocarbons, and a recycle stream of aromatics that are subject to further hydrocracking in the hydrocracking zone.

BRIEF DESCRIPTION OF THE DRAWINGS

The foregoing summary and the following detailed description of preferred embodiments of the invention will be best understood when read in conjunction with the attached drawings. For the purpose of illustrating the invention, there are shown in the drawings embodiments which are presently preferred. It should be understood, however, that the invention is not limited to the precise arrangements and instrumentalities shown. In the drawings the same numeral is used to refer to the same or similar elements, in which.

DETAILED DESCRIPTION OF THE INVENTION

Figure 1:
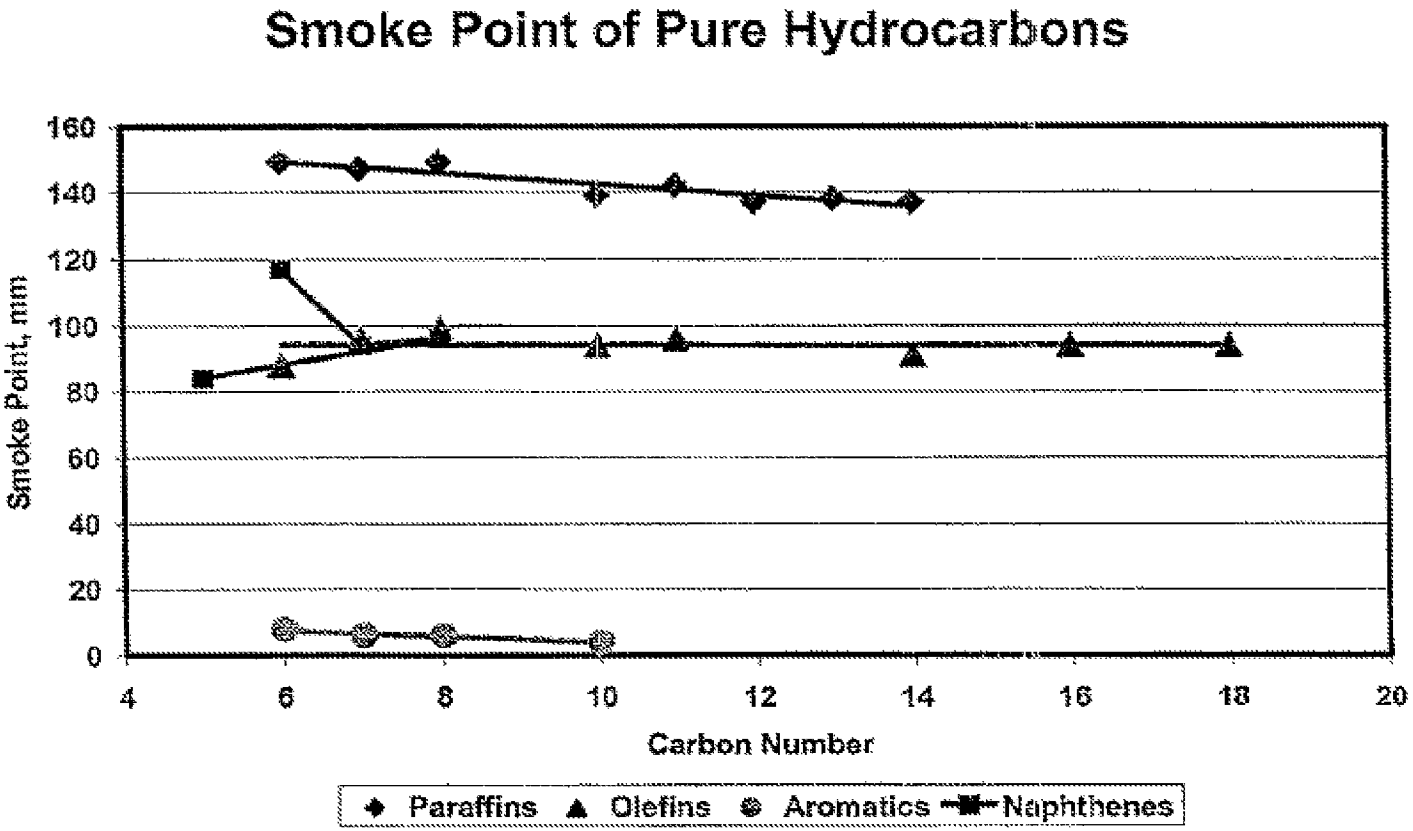
FIG. 1 (Prior Art)
FIG. 1 is a graph indicating the smoke point of pure hydrocarbons.
Figure 2:
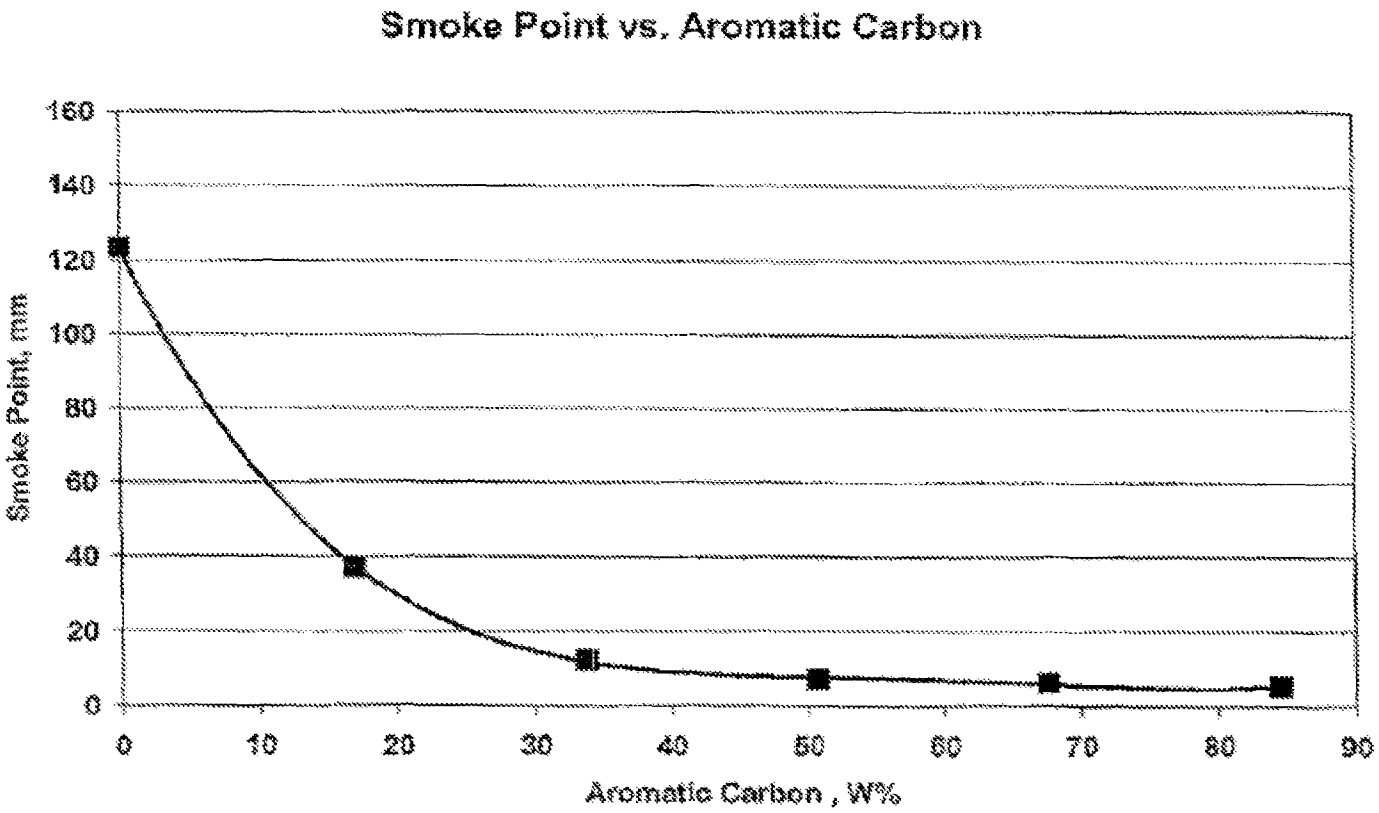
FIG. 2 (Prior Art)
FIG. 2 is a graph showing the impact on smoke point of aromatic hydrocarbons in a mixture.
Figure 3:
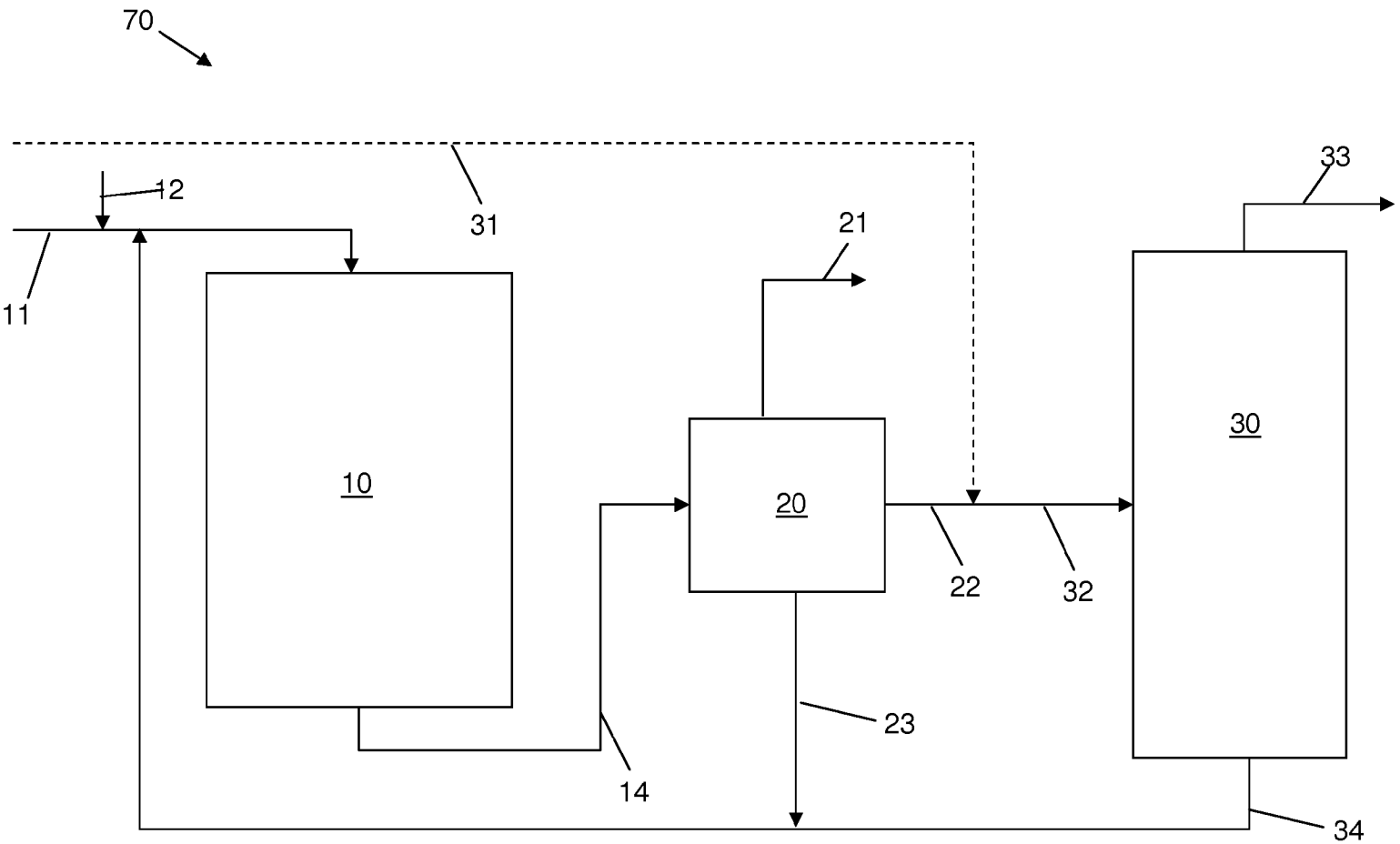
FIG. 3 is a schematic diagram of an integrated hydrocracking unit in accordance with the system and method of the present invention.

Referring to FIG. 3, an integrated hydrocracking and aromatic removal apparatus 70 is shown which generally includes a hydrocracking reaction zone 10, a fractionator 20 and an aromatic removal zone 30. A feedstock 11 boiling in the vacuum gas oil range of about 370° C. to about 560° C. is hydrotreated and/or hydrocracked in the hydrocracking reaction zone 10 over hydrotreating and/or hydrocracking catalysts. As is conventionally known, hydrotreating and/or hydrocracking catalysts can be supported on alumina, silica alumina or zeolite, and incorporate nickel/molybdenum, nickel/tungsten or cobalt/molybdenum as an active phase. Feedstock 11 can be a straight run vacuum gas oil with a final boiling point as high as about 565° C., deasphalted oil derived from vacuum residue or atmospheric residue with solvent deasphalting, heavy gas oils from coking processes, light or heavy cycle oils from fluid catalytic cracking process, and/or heavy gas oil from any other residue processing units. Feedstock 11 can be from conventional sources including, but not limited to crude oils, synthetic crude oils derived from heavy oil upgrading, shale oil, coal liquids, and/or tar sands.

Feedstock 11 and a hydrogen stream 12 are introduced in the hydrocracking reactor zone 10 as a combined stream 13. In the hydrocracking reactor zone 10, the high molecular weight, high boiling molecules are cracked into low molecular weight, low boiling point hydrocarbons. The conversion in the hydrocracking reactor zone 10 can range from about 5 wt % to about 99 wt %, depending on various factors including, but not limited to operating conditions, feedstock content, selection and amount of catalyst, and other factors that are conventionally known. In addition, heteroatoms including sulfur and nitrogen, and trace metals such as nickel, vanadium, and iron, can also be removed from the hydrocarbon compounds or mixture in the hydrocracking reactor zone 10.

The hydrocracking reactor zone 10 can contain one or more hydrocracking reactors for single stage or multiple stage hydrocracking.

A hydrocracking reactor effluent stream 14 from the hydrocracking reactor zone 10 is passed to a fractionator 20 for separation into a light stream 21, a middle distillate stream 22 and in unconverted bottoms stream 23. The fractionator 20 can be a distillation unit as is conventionally known including but not limited to a true boiling point distillation unit, e.g., having 15 or more theoretical plates, a flashing vessel with a theoretical plate number between 0.5-15, or a stripper column operating with a gas flow from the bottom.

Light stream 21, including $H_2S$, $NH_3$, light gases ($C_1$-$C_4$), and naphtha, and stream are discharged for further processing and/or separation (not shown). The unconverted bottoms stream 23 includes hydrocarbon fractions boiling above about 370° C., and is recycled back to the hydrocracking reactor zone 10 for further cracking.

The middle distillate stream 22 includes jet fuel/kerosene and diesel products boiling in the nominal range of about 180° C. to about 370° C. The middle distillate stream 22 can optionally be combined with one or more additional middle distillate streams 31 (shown in dashed lines in FIGS. 3-6), for instance, derived from other distillation processes in the same refinery complex, or from another source. The hydrocracked middle distillates stream 22 or the combined stream 32 boiling in the range of about 180° C. to about 370° C. is passed to the aromatic removal zone 30 for extraction of aromatic compounds. The aromatic removal zone 30 includes one or more solvent extraction units, shown in FIG. 4, an adsorption unit, shown in FIG. 5, or combination of solvent extraction and adsorption units, shown in FIG. 6.

A middle distillate product stream 33 is obtained from the aromatic removal zone 30 has a reduced level of aromatic compounds. In certain preferred embodiments, middle distillate product stream 33 is aromatic-free. The aromatic residue 34 from the aromatic removal zone 30 is recycled back to the hydrocracking zone 10 for cracking and hydrogenation. In a hydrocracking zone 10 containing multiple stages of reactors, the aromatic recycle can be sent to any of the reactors. Since extracted aromatics have boiling points in the range of diesel, the hydrocracking operating severity is sufficient to hydrogenate and crack the aromatics. In certain embodiments, a bleed stream can be provided from stream 34 in the event of excess aromatics, with a bleed rate would be in the range about 0.5 V % to about 5 V % of the total volume of stream 34. The bleed stream may be passed to other processing units such as FCC, residue processing units such as coking, solvent deasphalting, gasification, or the fuel oil pool.

According to the present invention, the middle distillate product stream 33 has a higher smoke point than the middle fraction 22 from the fractionator 20. In particular, in certain embodiments, the middle fraction 22 from the fractionator 20 has a smoke point of ≤35 millimeters, and the product stream 33 from the aromatic separation zone has a smoke point of >35 millimeters, in certain embodiments between 35 millimeters and 120 millimeters.

Figure 4:
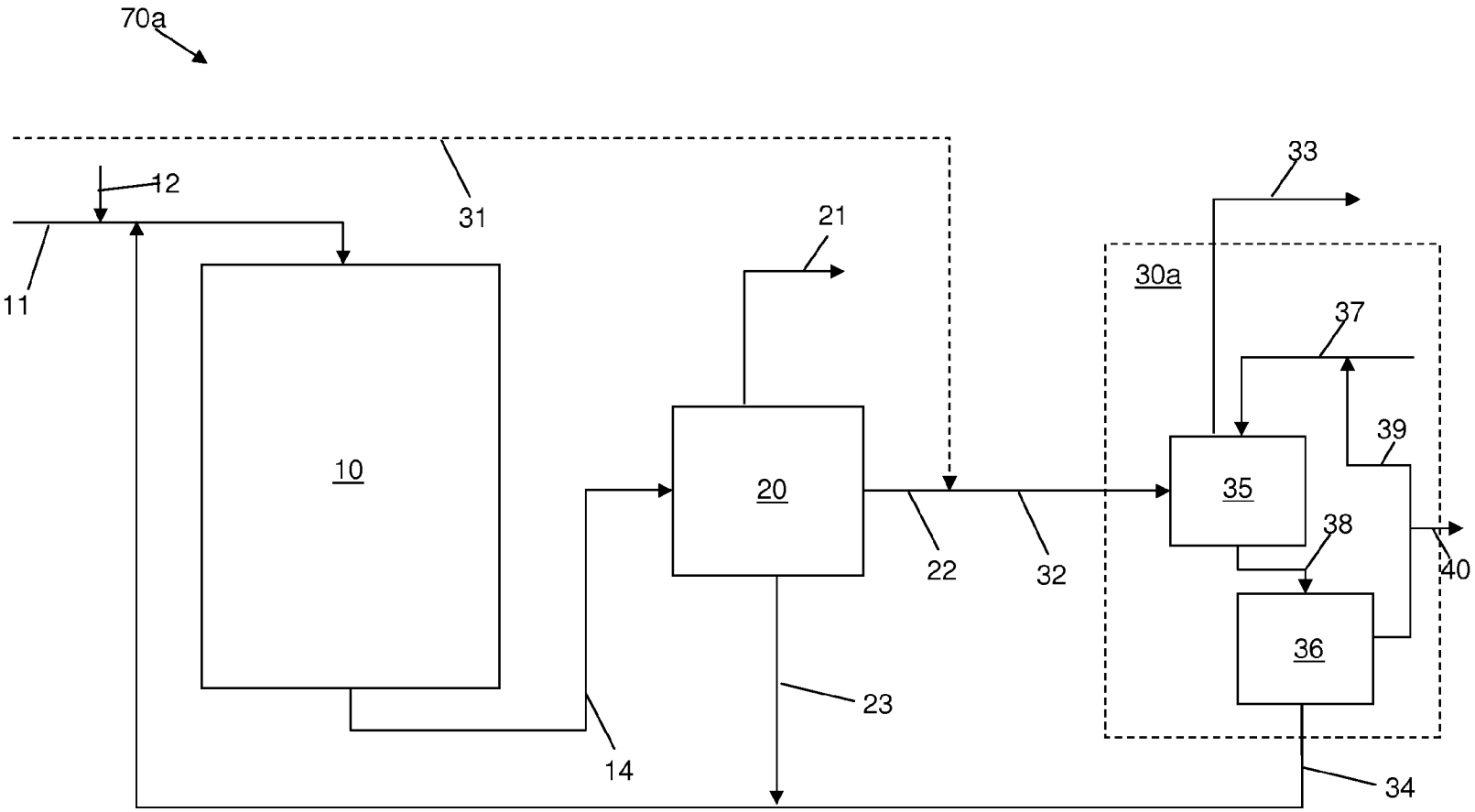
FIG. 4 is a schematic diagram of an integrated hydrocracking unit employing liquid solvent aromatic extraction in accordance with an embodiment of the system and method of the present invention.

Referring to FIG. 4, an integrated hydrocracking and aromatic removal apparatus 70*a* is schematically depicted, and includes the hydrocracking reaction zone 10, a fractionator 20 and an aromatic removal zone 30*a* including a solvent extraction unit. The solvent extraction unit, which is conventionally known, generally includes an extraction unit 35 and a solvent recovery unit 36. The hydrocracked middle distillates stream 22 or the combined stream 32 is passed to the extraction unit 35. Extraction solvent 37 is also introduced into the extraction unit 35 in which the solvent and the middle distillate are intimately mixed to remove aromatics. The product stream 33 is discharged, having a reduced level of aromatic compounds, and in certain preferred embodiments, the middle distillate product stream 33 is aromatic-free. The solvent and dissolved aromatics are passed from the extraction unit 35 via stream 38 to the solvent recovery unit 36. Aromatics are recycled via stream 34 to the hydrocracking zone 10 for hydrogenation and cracking.

Figure 5:
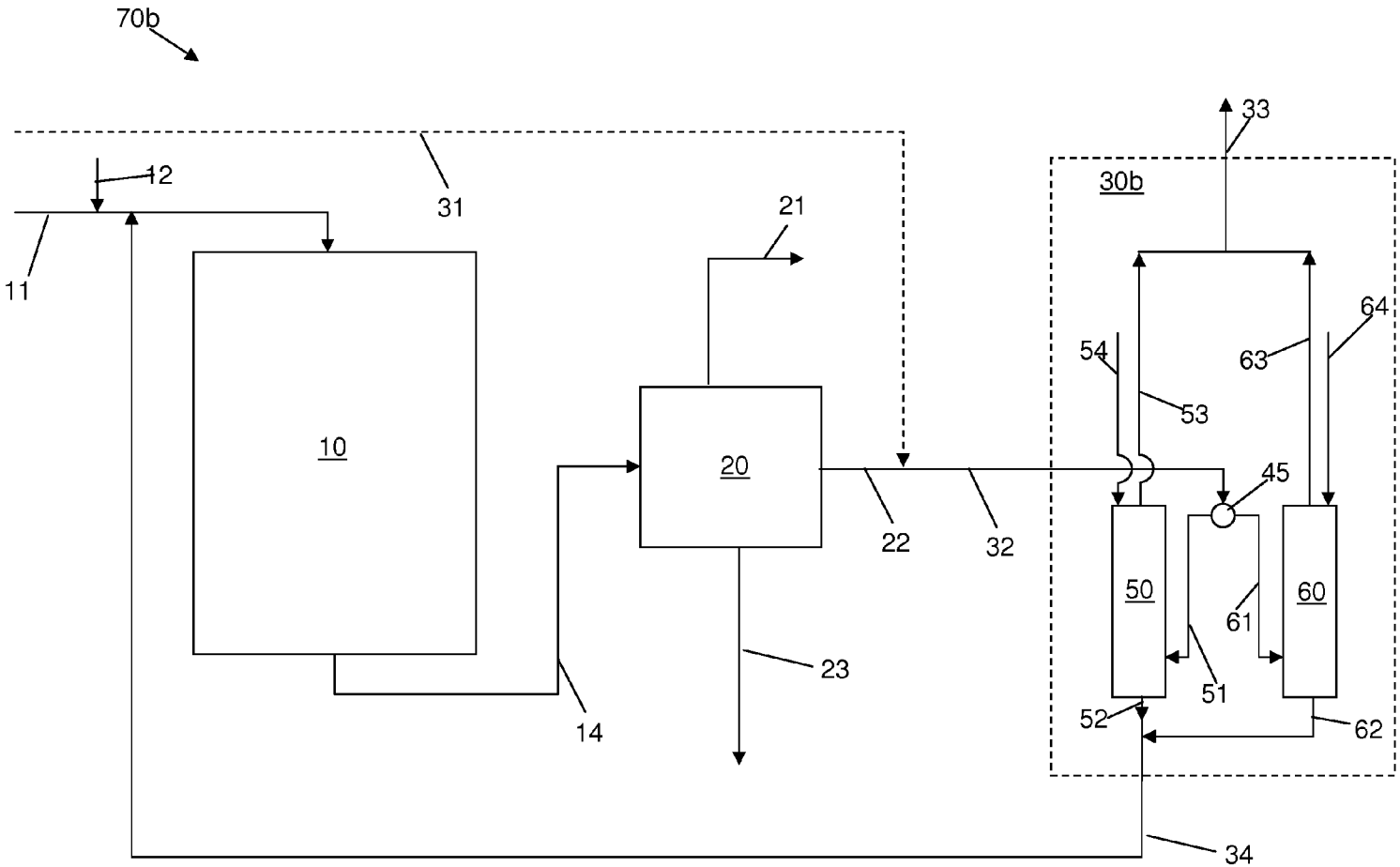
FIG. 5 is a schematic diagram of an integrated hydrocracking unit employing adsorptive aromatic extraction in accordance with another embodiment of the system and method of the present invention.

Referring to FIG. 5, an integrated hydrocracking and aromatic removal apparatus 70*b* is schematically depicted, which includes the hydrocracking reaction zone 10, a fractionator 20 and an aromatic removal zone 30*b* that includes an adsorption apparatus. The adsorption apparatus includes parallel adsorption units 50, 60 as is conventionally known in the adsorption art, such that while one is adsorbing an adsorbate on an adsorbent, the other is desorbing the adsorbate from the adsorbent. The hydrocracked middle distillates stream 22 or the combined stream 32 is passed to one of the adsorption units 50, 60 through valve 45. Product streams 53, 63 are discharged from the adsorption units 50, 60, respectively, as product stream 33, having a reduced level of aromatic compounds, and in certain preferred embodiments, the middle distillate product stream 33 is aromatic-free. During a desorption cycle of the aromatic removal zone 30*b* including an adsorptive system, desorption fluid is introduced via streams 54, 64 to adsorption units 50, 60, respectively. Aromatics that were adsorbed on the adsorbent are discharged via streams 52, 62, respectively. Aromatics are recycled via stream 34 back to the hydrocracking zone 10 for hydrogenation and cracking.

Figure 6:
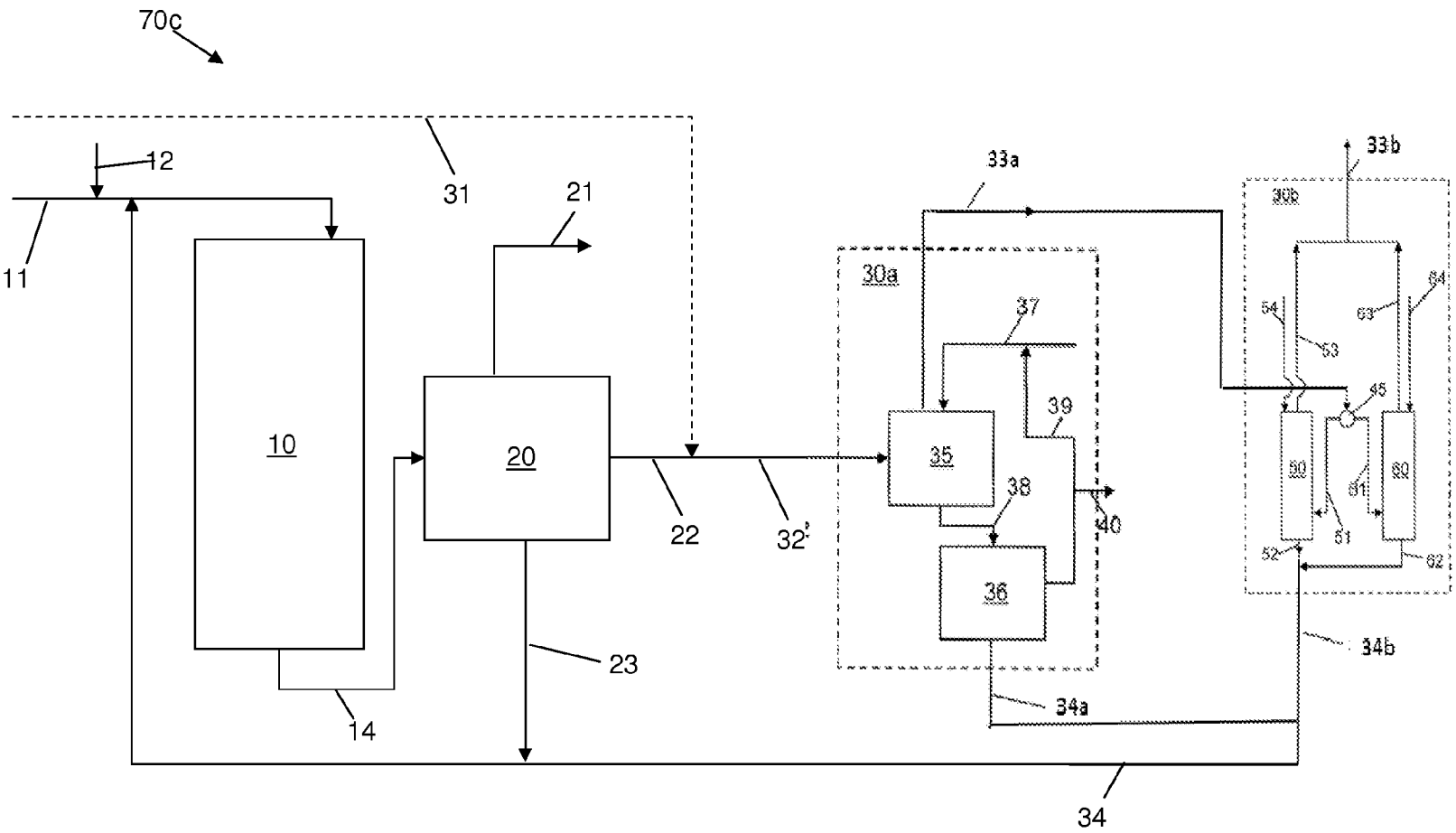
FIG. 6 is a schematic diagram of an integrated hydrocracking unit employing a combination of adsorptive aromatic extraction and liquid solvent aromatic extraction in accordance with a further embodiment of the system and method of the present invention.

Referring to FIG. 6, an integrated hydrocracking and aromatic removal apparatus 70*c* is schematically depicted, including the hydrocracking reaction zone 10, a fractionator 20 and aromatic removal zones 30*a* and 30*b* including a solvent extraction unit and an adsorption unit. The solvent extraction unit 30*a*, which is conventionally known, generally includes an extraction unit 35 and a solvent recovery unit 36. The hydrocracked middle distillates stream 22 or the combined stream 32 is passed to the extraction unit 35. Extraction solvent 37 is also introduced into the extraction unit 35 where the solvent and the middle distillate are intimately mixed to remove aromatics. The product stream 33*a* is sent to adsorption unit via valve 45 for further aromatics removal. The solvent and dissolved aromatics are passed from the extraction unit 35 via stream 38 to the solvent recovery unit 36.

The adsorption apparatus 30*b* includes parallel adsorption units 50, 60 as is conventionally known in the adsorption art, such that while one is adsorbing an adsorbate on an adsorbent, the other is desorbing the adsorbate from the adsorbent. Product streams 53, 63 are discharged from the adsorption units 50, 60, respectively, as product stream 33*b*, having a reduced level of aromatic compounds, and in certain preferred embodiments, stream 33*b* is aromatic-free. During a desorption cycle of the aromatic removal zone 30*b* including an adsorption system, desorption fluid is introduced via streams 54, 64 to adsorption units 50, 60, respectively. Aromatics that were adsorbed on the adsorbent are discharged via streams 52, 62, respectively. Aromatics stream 34*a* from extraction zone 30*a* are combined with the aromatics stream 34*b* from adsorption zone 30*b* and the combined stream 34 is recycled back to the hydrocracking zone 10 for hydrogenation and cracking.

EXAMPLE

The following example illustrates a specific embodiment of the method of this invention. The scope of this invention is not to be considered as limited by the specific embodiment described therein, but rather as defined by the claims.

A VGO/DMO blend feedstock was provided having the following properties:

TABLE 2

| | | |
|---|---|---|
| Density | | 0.9190 g/cc |
| Sulfur content | | 2.38 W % |
| Nitrogen content | | 815 ppmw |
| Boiling Point | Initial BP | 249° C. |
| | 10 W % BP | 364° C. |
| | 30 W % BP | 423° C. |
| | 50 W % BP | 461° C. |
| | 70 W % BP | 502° C. |
| | 90 W % BP | 573° C. |

The feedstock was hydrocracked in a once-thru hydrocracking configuration at a liquid hourly space velocity of 0.326 at a hydrogen to oil ratio of 1,262:1. The hydrogen partial pressure was maintained at 117 Kg/cm$^2$ and the system was operated at weighted average bed temperatures (WABT) of 355° C., 369° C. and 384° C. The hydrocracked products resulted a jet/kerosene stream with cut point in the range 185-240° C. with the properties shown in the following table:

TABLE 3

| WABT, ° C. | 355 | 369 | 384 |
|---|---|---|---|
| Smoke point, mm | 26 | 29 | 31 |
| Saturate, W % | 85 | 92 | 92 |
| Aromatics, W % | 15 | 8 | 8 |

The jet/kerosene stream is then sent to aromatic extraction unit and the aromatics are extracted in an extractor having 3 theoretical stages at 60° C. from the stream using furfural as solvent at 3:1 solvent to feed ratio. The aromatic levels were reduced and as a result the smoke points showed substantial increase as shown in the following table.

TABLE 4

| WABT, ° C. | 355 | 369 | 384 |
|---|---|---|---|
| Smoke point, mm | 68 | 67 | 58 |
| Aromatics, W % | 5.7 | 3.1 | 3.1 |

The process of the invention has been described and explained with reference to the schematic process drawings and examples. Additional variations and modifications will be apparent to those of ordinary skill in the art based on the above description and the scope of the invention is to be determined by the claims that follow.

What is claimed is:

1. A process for producing reduced aromatic hydrocarbon products comprising:

a. hydrocracking a hydrocarbon feedstock in a hydrocracking zone;

b. passing a hydrocracked effluent from the hydrocracking zone to a fractionator and recovering a light fraction, a middle fraction containing aromatic compounds and a heavy fraction from the fractionator, wherein the middle fraction includes hydrocarbons having nominal boiling points in the range of 180-370° C.;

c. recycling the heavy fraction to the hydrocracking zone for further hydrocracking;

d. passing the middle fraction to an aromatic separation zone;

e. recovering a product stream from the aromatic separation zone comprising a middle fraction having a reduced content of aromatic compounds compared to the middle fraction recovered from the fractionator; and f. recycling aromatics from the aromatic separation zone to the hydrocracking zone for further hydrogenation and cracking.

2. The process of claim 1, further comprising introducing a second separate stream of a middle fraction from a different source into the aromatic separation zone.

3. The process of claim 1, wherein the middle fraction from the fractionator has a smoke point of ≤35 millimeters and the product stream from the aromatic separation zone has a smoke point of >35 millimeters.

4. The process of claim 1, wherein the middle fraction from the fractionator has a smoke point of 25-35 millimeters and the product stream from the aromatic separation zone has a smoke point of 35 millimeters to 120 millimeters.

5. The process of claim 1, wherein the aromatic separation zone includes a solvent extraction process.

6. The process of claim 1, wherein the aromatic separation zone includes an adsorption process.

7. The process of claim 1, wherein the aromatic separation zone includes a solvent extraction process and an adsorption process.

8. A middle distillate hydrocarbon production process comprising:

a. hydrocracking a hydrocarbon feedstock having a nominal boiling point above 370° C. in a hydrocracking zone to thereby remove heteroatoms including sulfur and/or nitrogen, and/or metals including nickel, vanadium and/or iron, and crack molecules having a nominal boiling point over 370° C. to molecules having a nominal boiling point under 370° C.;

b. recovering a hydrocracked effluent from the hydrocracking zone and passing it to a fractionator for separation into a light fraction including H2S, NH3, C1-C4 hydrocarbons, and naphtha, a middle fraction including hydrocarbons having nominal boiling points in the range of 180-370° C., and a heavy fraction having nominal boiling points greater than 370° C.;

c. recycling the heavy fraction from step (b) to the hydrocracking zone for further hydrocracking;

d. passing the middle fraction containing aromatic compounds to an aromatic separation zone;

e. recovering a product stream from the aromatic separation zone comprising a middle fraction having a reduced content of aromatic compounds compared to the middle fraction from the fractionator; and f. recycling aromatics from the aromatic separation zone to the hydrocracking zone for further hydrogenation and cracking.

9. The process of claim 8, further comprising introducing a second separate stream of a middle fraction from a different source into the aromatic separation zone.

10. The process of claim 8, wherein the middle fraction from the fractionator has a smoke point of ≤35 millimeters and the product stream from the aromatic separation zone has a smoke point of >35 millimeters.

11. The process of claim 8, wherein the middle fraction from the fractionator has a smoke point of 25-35 millimeters and the product stream from the aromatic separation zone has a smoke point of 35 millimeters to 120 millimeters.

* * * * *